US006644765B2

(12) United States Patent
Lim

(10) Patent No.: US 6,644,765 B2
(45) Date of Patent: Nov. 11, 2003

(54) APPARATUS FOR AND METHOD OF ADJUSTING A POSITION OF A PRINTING HEAD IN AN INKJET PRINTER

(75) Inventor: Gui-taek Lim, Suwon (KR)

(73) Assignee: Samsung Electronics Co. Ltd., Suwon (KR)

( * ) Notice: Subject to any disclaimer, the term of this patent is extended or adjusted under 35 U.S.C. 154(b) by 0 days.

(21) Appl. No.: 10/161,690

(22) Filed: Jun. 5, 2002

(65) Prior Publication Data

US 2003/0107610 A1 Jun. 12, 2003

(30) Foreign Application Priority Data

Dec. 12, 2001 (KR) ..... 2001-78484

(51) Int. Cl.[7] ..... B41J 25/308
(52) U.S. Cl. ..... 347/8; 347/37; 400/55
(58) Field of Search ..... 347/8, 37; 400/55, 400/59, 60; 318/696

(56) References Cited

U.S. PATENT DOCUMENTS 5,696,541 A * 12/1997 Akahane et al. ..... 347/8
6,059,392 A * 5/2000 Park ..... 347/8
6,075,336 A * 6/2000 Sugai et al. ..... 318/696
6,270,184 B1 * 8/2001 Igarashi et al. ..... 347/37

* cited by examiner

*Primary Examiner*—Anh T. N. Vo
(74) *Attorney, Agent, or Firm*—Staas & Halsey LLP

(57) ABSTRACT

An apparatus for adjusting a position of a printing head in an inkjet printer includes an adjusting device disposed in a head carrier to adjust an arrangement or orientation of the printing head mounted in the head carrier. The adjusting device includes a positioning member disposed in the head carrier to position and mount the printing head at a predetermined position, and a positioning member adjuster adjusting a position of the positioning member to control the arrangement or orientation of the printing head. Accordingly, the apparatus for adjusting the position of the printing head can prevent a switching problem that ink is unevenly ejected on printing paper, by controlling the positioning member adjuster to adjust the position of the positioning member contacting a fixing surface of the printing head to be parallel to the carrier shaft.

37 Claims, 5 Drawing Sheets

APPARATUS FOR AND METHOD OF ADJUSTING A POSITION OF A PRINTING HEAD IN AN INKJET PRINTER

CROSS-REFERENCE TO RELATED APPLICATION

This application claims the benefit of Korean No. 2001-78484, filed Dec. 12, 2001, in the Korean Industrial Property office, the disclosure of which is incorporated herein by reference.

BACKGROUND OF THE INVENTION

1. Field of the Invention

The present invention relates to an inkjet printer, and more particularly to an apparatus for and a method of adjusting a position of a printing head mounted in a head carrier of an inkjet printer by adjusting a position of a parallel adjustment shaft contacting a fixing surface of the printing head to be parallel to a carrier shaft of the head carrier.

2. Description of the Related Art

Generally, data or files generated from a computer are changed in a written form by being printed on printing paper through a printer. In changing data or files in the written form, various types of printers are used. For example, an inkjet printer performs a printing operation by heating ink stored in a cartridge to generate bubbles and ejecting the ink by the generated bubbles in a given form on the paper through an ink ejection nozzle.

Usually, an inkjet printer 10, as shown in FIGS. 1 and 2, includes a paper feeder 20 containing printing paper P, a paper transporter 30 transporting the paper P from the paper feeder 20, a printing part 40 printing data on the paper P transported through the paper transporter 30 by moving a head carrier 46 mounted with the printing head 41 therein in right and left directions along a carrier shaft 42, and a paper-discharging part 60 discharging the paper P printed by the printing part 40 to an outside of the inkjet printer 10.

As shown in FIGS. 3 and 4, to correctly eject ink on the printing paper P when the printing head 41 is moved to the right and left directions along the carrier shaft 42 to print data on the paper P, the inkjet printer 10 has a parallel adjustment shaft 44 formed at a lower part of the head carrier 46 to position and fix (mount) the printing head 41 on a lower supporter 45 of the head carrier 46 at a predetermined position, for example the position in which a lower fixing surface 23 of the printing head 41 is maintained to be parallel to the carrier shaft 42.

In an operation, as shown in FIG. 2, the printing paper P contained in the paper feeder 20 is elastically supported by a lockup spring 21 and picked up by a pickup roller 22 and then moved to the paper transporter 30.

At the paper transporter 30, the paper P is transported to the printing part 40 by a rotation of a feed roller 31 and a friction roller 32. Thus, as the paper P is transported from the paper transporter 30 to the printing part 40, a motor 45 driving a head carrier assembly operates to drive a belt 43. Consequently, the printing head 41 having an ink ejection nozzle 41*a*, which is mounted in the head carrier 46, is moved in the left and right directions along the carrier shaft 42 and ejects ink on the paper P transported by the paper transporter 30 to print pictures or letters thereon.

As the paper P is gradually moved along a base frame 50 after printing by the nozzle 41*a* of the printing head 41, the printing paper P arrives at the paper-discharging part 60. At the paper-discharging part 60, the paper P is discharged to the outside through paper-discharging rollers 61 and star-shaped wheels 62.

However, in the inkjet printer 10, when due to manufacturing and assembling errors, the lower fixing surface 23 of the printing head 41 is not maintained to be parallel to the parallel adjustment shaft 44 fixed in the head carrier 46, or when the parallel adjustment shaft 44 itself is not maintained to be parallel to the carrier shaft 42, there was no way to adjust a position of the parallel adjustment shaft 44, i.e., an arrangement or orientation of the printing head 41 with respect to carrier shaft 42 or the parallel adjustment shaft 44, since the parallel adjustment shaft 44 positioning the printing head 41 at the predetermined position is fixed to be unmovable at the lower part of the head carrier 46.

Also, even though the printing head 41 is first positioned at a correct position, it can be deviated from the first position by mechanical frictions or loads in the printing operation ever a long period of time, and thereby the first position becomes changed or varying so as not to be parallel to the parallel adjustment shaft 44 or the carrier shaft 42.

If the printing head 41 is not maintained to be parallel to the parallel adjustment shaft 44 or the carrier shaft 42, a "switching" problem occurs in which ink is unevenly ejected on the paper from the ink injection nozzle 41*a* of the printing head 41, thereby a printing quality may deteriorate.

SUMMARY OF THE INVENTION

Therefore, it is an object of the present invention to provide an improved apparatus for and a method of adjusting a position of a printing head mounted in a head carrier of an inkjet printer, the apparatus controlling an arrangement or orientation of the printing head with respect to the head carrier.

It is another object to provide an improved apparatus for and a method of adjusting a position of a printing head in an inkjet printer by adjusting a position of a parallel adjustment shaft having a fixing surface of the printing head mounted in a head carrier to be parallel to a carrier shaft guiding a movement of the head carrier.

Additional objects and advantageous of the invention will be set forth in part in the description which follows and, in part, will be obvious from the description, or may be learded by practice of the invention.

These and other objects according to an embodiment of the present invention may be achieved by providing an apparatus adjusting a position of a printing head in an inkjet printer having the printing head ejecting ink to perform a printing operation, and a head carrier mounted with the printing head and moving along a carrier shaft. The apparatus includes a device disposed in the head carrier to adjust an arrangement or orientation of the printing head with respect to the head carrier. The adjusting device includes a positioning member disposed in the head carrier to position and mount the printing head in a predetermined position, and a positioning member adjuster to adjust a position of the positioning member to control the arrangement or orientation of the printing head.

The positioning member includes a parallel adjustment shaft positioning and mounting a fixing surface of the printing head to be parallel to the carrier shaft at a lower part of the head carrier.

The positioning member adjuster includes a first receiving hole formed at the head carrier to receive and support the parallel adjustment shaft moving in a direction perpendicular to an axial direction of the parallel adjustment shaft, an eccentric cam disposed at the head carrier in the vicinity of the first receiving hole to be in contact with the parallel adjustment shaft, an actuation lever formed at one side of the eccentric cam to rotate the eccentric cam, and a pressing part pushing the parallel adjustment shaft to come in contact with the eccentric cam. Preferably, the pressing part includes a first elastic spring disposed in a first mounting groove formed in a wall defining the first receiving hole to push the parallel adjustment shaft toward the eccentric cam.

Also, the positioning member adjuster may be disposed at the head carrier in relation to one end of the parallel adjustment shaft. In this case, a pressing device can be disposed at the head carrier in relation to the other end of the parallel adjustment shaft without an additional positioning member adjuster to push the other end of the parallel adjustment shaft toward the fixing surface of the printing head. The other end of the parallel adjustment shaft is disposed within an adjusting range of the positioning member adjuster without overly moving away from the fixing surface of the printing head. The pressing device may include a second receiving hole formed at the head carrier to allow the other end of the parallel adjustment shaft without the additional positioning member adjuster to be movable in the direction perpendicular to the axial direction of the parallel adjustment shaft, and a second elastic spring disposed in a second mounting groove formed in a second wall defining the second receiving hole to push the other end of the parallel adjustment shaft toward the fixing surface of the printing head.

The positioning member can further include a locking part releasably locking the actuation lever onto one of a plurality of selected positions. The locking part may include a projection formed at an end of the actuation lever, and at least one locking groove formed at a portion of the head carrier corresponding to the projection along a movement path thereof.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
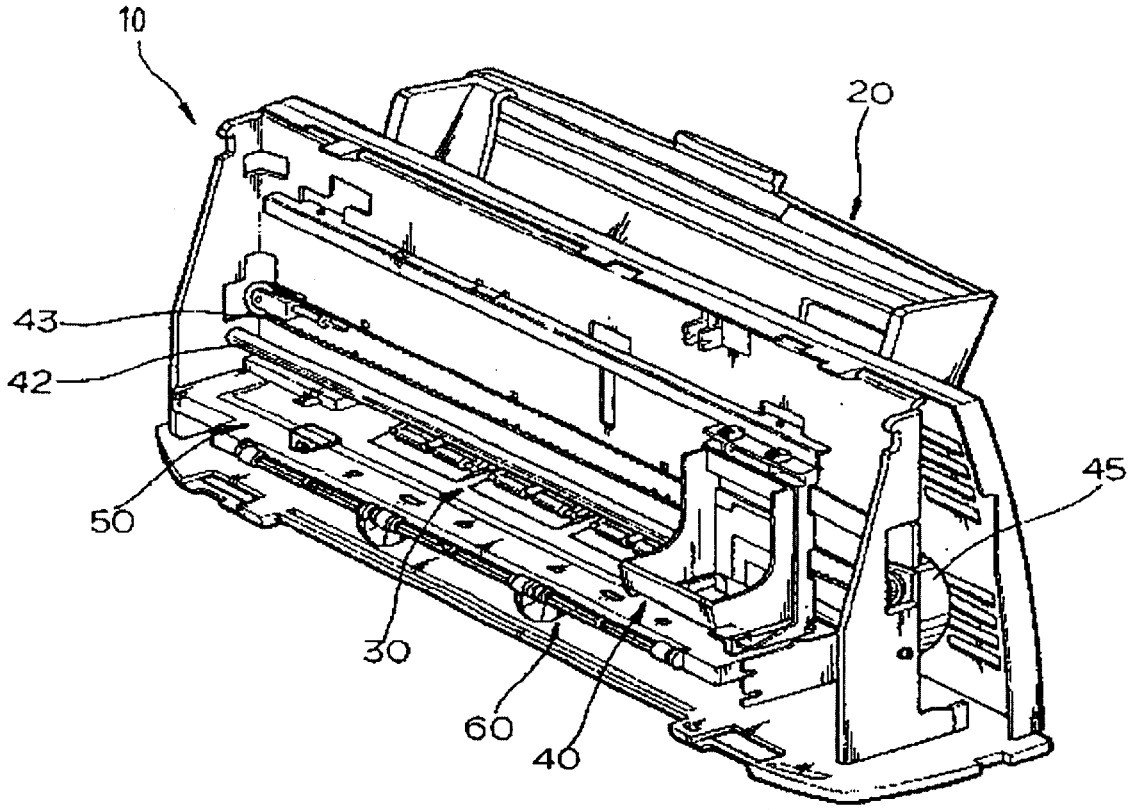
FIG. 1 (PRIOR ART)
FIG. 1 is a partial perspective view of a general inkjet printer.
Figure 2:
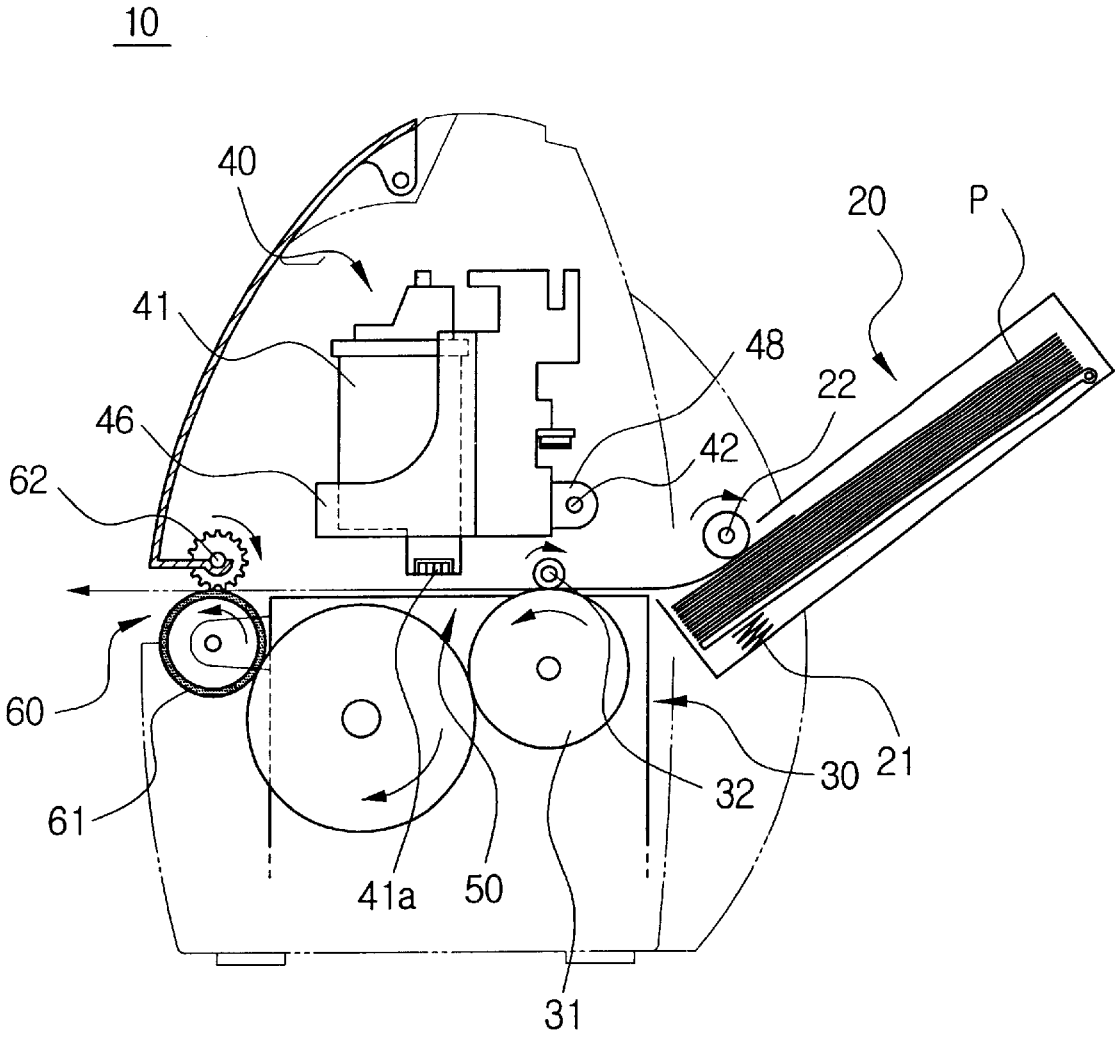
FIG.2 (PRIOR ART)
FIG. 2 is a partial cross-sectional view of the general inkjet printer of FIG. 1.
Figure 3:
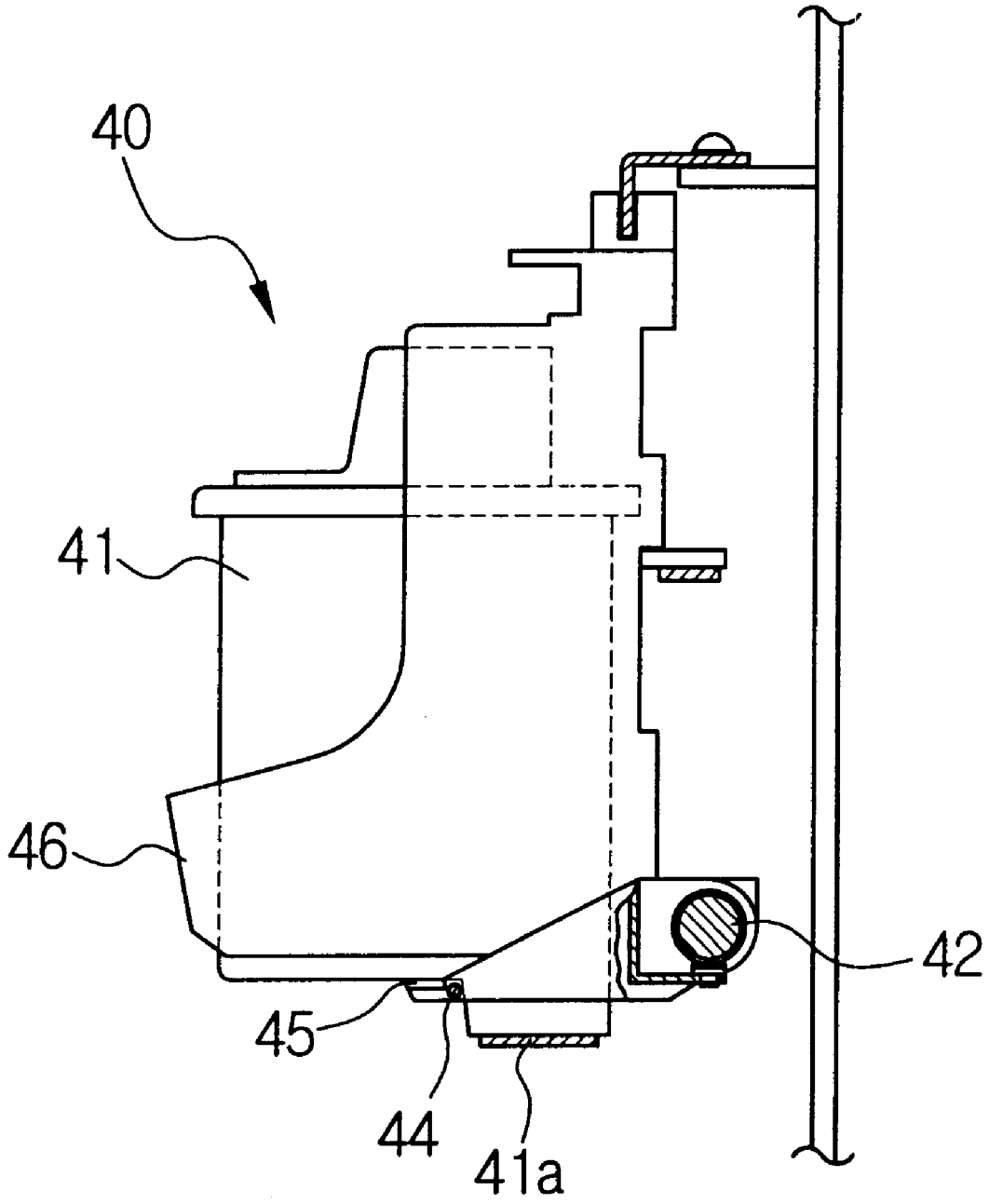
FIG.3 (PRIOR ART)
FIG. 3 is a side view of a head carrier assembly of the inkjet printer shown in FIG. 1.
Figure 4:
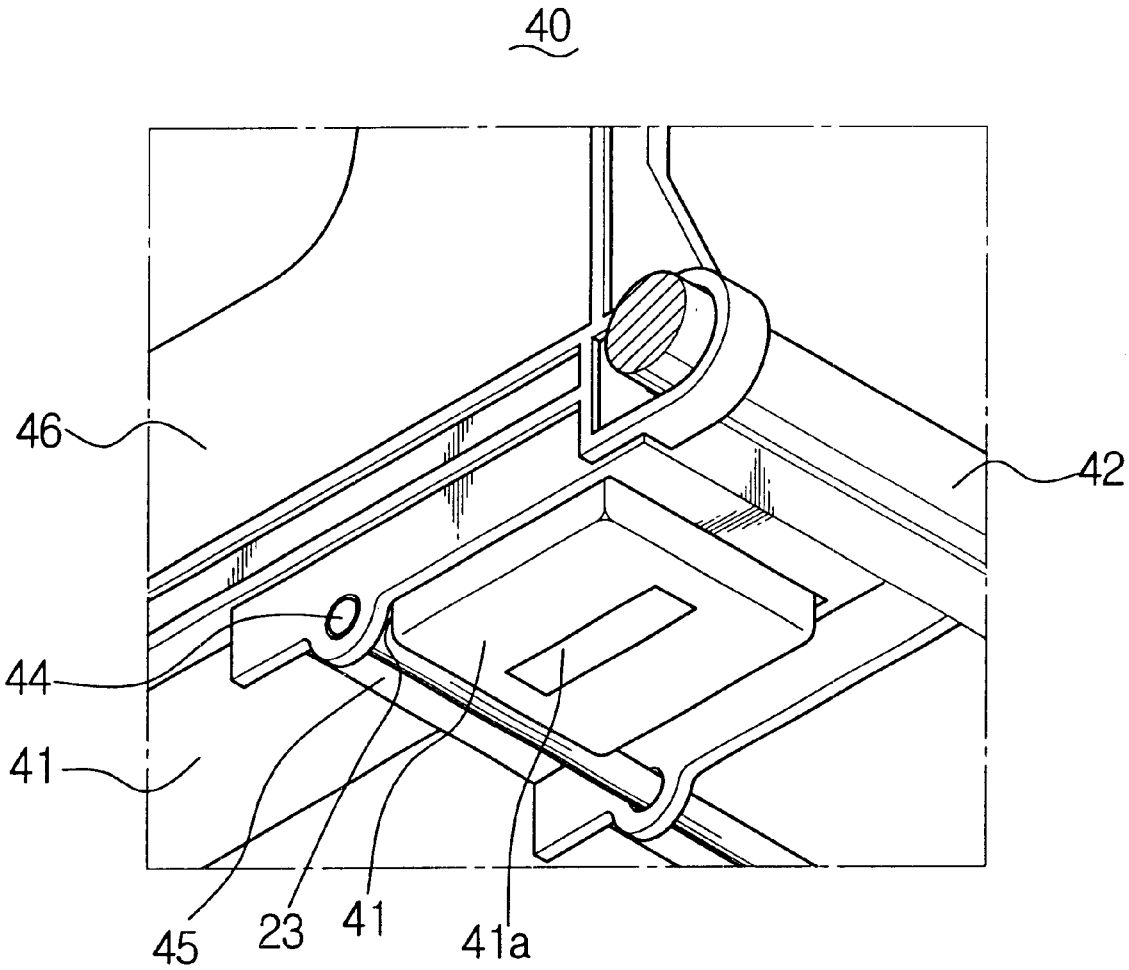
FIG.4 (PRIOR ART)
FIG. 4 is a partial perspective view of the head carrier assembly shown in FIG. 3.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Figure 5:
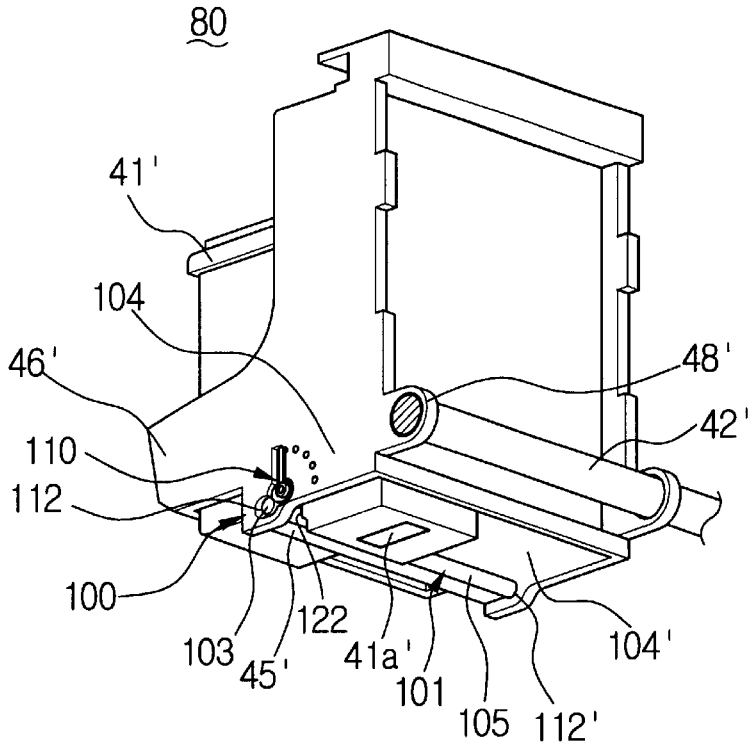
FIG. 5 is a perspective view of a head carrier assembly having an adjusting apparatus adjusting a position of a printing head mounted in an ink jet printer in accordance with an embodiment of the present invention.

Referring now to FIG. 5, there is illustrated a head carrier assembly 80 having an adjusting apparatus 100 adjusting a position of a printing head with respect to a head carrier 46' in accordance with an embodiment of the present invention.

The head carrier assembly 80 includes the head carrier 46' having a receptacle receiving a printing head 41', a carrier shaft guide 48' receiving and supporting a carrier shaft 42' to allow the head carrier 46' to be movable along the carrier shaft 42', and the adjusting apparatus 100 adjusting the position of the printing head 41' disposed at a lower portion of the head carrier 46'.

The adjusting apparatus 100 adjusting the position of the printing head 41' has a positioning member 101 positioning and fixing (mounting) the printing head 41' at a predetermined position of the head carrier 46', and a positioning member adjuster 110 adjusting (controlling) a position of the positioning member 101 to adjust an arrangement or orientation of the printing head 41' with respect to the head carrier 46'.

The positioning member 101 includes a parallel adjustment shaft 102 supported in first and second receiving holes 112, 112', each of which is formed in first and second lower sidewalls 104, 104' of the head carrier 46' to position and fix (mount) a lower surface 122 of the printing head 41' on a lower supporter 45' of the head carrier 46' to be parallel to the carrier shaft 42'.

Figure 6:
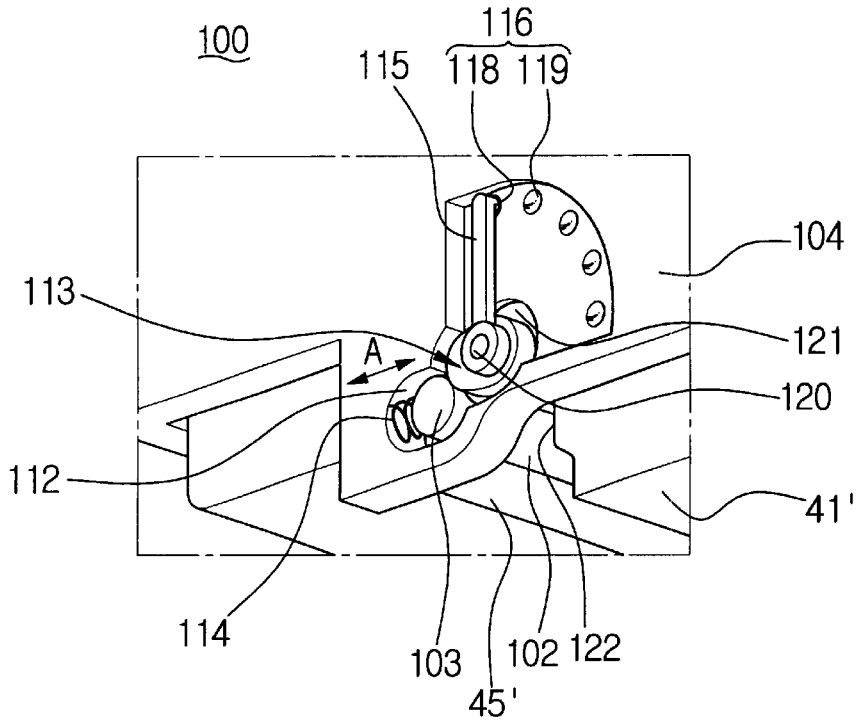
FIG. 6 is a partial perspective view of the adjusting apparatus of the head carrier assembly of FIG. 5.

As shown in FIG. 6, the positioning member adjuster 110 includes a first receiving hole 112 receiving and supporting one end 103 of the parallel adjustment shaft 102 to be movable in a direction perpendicular to an axial direction of the parallel adjustment shaft 102, i.e., an arrow direction A of FIG. 6, an eccentric cam 113 fixed on or coupled to a rotation axle 120 in a mounting groove 121 formed in the vicinity of the first receiving hole 112, an actuation lever 115 formed at one side of the eccentric cam 113 to rotate the eccentric cam 113, and a pressing part 114 disposed in the first receiving hole 112 and between the parallel adjustment shaft 102 and the first lower sidewall 104 to push one end 103 of the parallel adjustment shaft 102 to come in contact with the eccentric cam 113.

The one end 103 of the parallel adjustment shaft 102 moves within the first receiving hole 112 in the arrow direction A which is parallel to one of lines coupled between centers of the rotation axle 120 and the parallel adjustment shaft 102 and between centers of the parallel adjustment shaft 102 and the carrier shaft 42'. Alternatively, it should be noted that in the embodiment, the one end 103 of the parallel adjustment shaft 102 is illustrated and explained as moving within the first receiving hole 112 in the arrow direction A, but the positioning member adjuster 110 can be composed to move it in other direction, for example, a radial direction of the rotation axle 120 during contacting a surface of the eccentric cam 113.

The first receiving hole 112 has an elliptical shape, which is enlarged in the arrow direction A to movably receive one end 103 of the parallel adjustment shaft 102.

The eccentric cam 113 has a cam surface of which an eccentric distance from a center of the rotation axle 120 is gradually changed to enable one end 103 of the parallel adjustment shaft 102 to be moved in the arrow direction A according to the rotated position thereof when the cam surface of the eccentric cam 113 comes in contact with the one end 103 of the parallel adjustment shaft 102.

The pressing part 114 includes a first elastic spring disposed in a first mounting groove (not shown) formed in a wall defining the first receiving hole 112 to push the one end 103 of the parallel adjustment shaft 102 toward the eccentric cam 113.

Also, the positioning member adjuster 110 includes a locking part 116 locking the eccentric cam 113 at one of a plurality of selected positions. The eccentric cam 113 pushes the one end 103 of the parallel adjustment shaft 102 against the elastic spring of the pressing part 114 after the eccentric cam 113 is rotated by the actuation lever 115 to move the one end 103 of the parallel adjustment shaft 102 in the arrow direction A. The locking part 116 includes a projection 118 formed at a distal end of the actuation lever 115, and a plurality of locking holes or grooves 119 formed at a portion of the first lower sidewall 104 of the head carrier 46' corresponding to the projection 118 along a movement path thereof. The number and intervals of the locking grooves 119 are determined according to movement intervals in the arrow direction A of the one end 103 of the parallel adjustment shaft 102.

Thus, in the adjusting apparatus 100 for adjusting the position of the printing head 41', when the eccentric cam 113 is rotated by the actuation lever 115, the eccentric cam 113 moves the one end 103 of the parallel adjustment shaft 102 in the arrow direction A so that the one end 103 of the parallel adjustment shaft 102 can come in contact with or move away from the lower fixing surface 122 of the printing head 41'. According to a movement of the one end 103 of the parallel adjustment shaft 102, the low fixing surface 112 of the printing head 41' is moved away and toward the rotation axle 120 and the carrier shaft 42'.

Also, after the lower fixing surface 122 of the printing head 41' is adjusted to be parallel to the carrier shaft 42' by the actuation lever 115 and the eccentric cam 113, the actuation lever 115 is secured by the locking part 116 to lock up the one end 103 of the parallel adjustment shaft 102 and the eccentric cam 113 at an adjusted position.

Here, although the positioning member adjuster 110 is disposed only in relation to the one end 103 of the parallel adjustment shaft 102, an additional positioning member adjuster 110 can be disposed on the other end 105 thereof.

When the positioning member adjuster 110 is disposed only in relation to the one end 103 other than both ends of the parallel adjustment shaft 102, a pressing device (not shown) may be installed on the other end 105 of the parallel adjustment shaft 102 to push the other end 105 of the parallel adjustment shaft 102 toward the lower fixing surface 122 of the printing head 41' without the additional positioning member adjuster 110. The pressing device does not actively adjust the position of the parallel adjustment shaft 102, but functions to provide a design margin to allow the other end 105 of the parallel adjustment shaft 102 to be disposed within an adjusting range of the positioning member adjuster 110 without overly moving away from the lower fixing surface 122 of the printing head 41' even though manufacturing and assembling errors occur.

The pressing device includes a second receiving hole (not shown) having an elliptical shape enlarged to allow the other end 105 of the parallel adjustment shaft 102 without the additional positioning member adjuster 110 to be movable in the arrow direction A, and a second elastic spring (not shown) disposed in a second mounting groove (not shown) formed in a second wall defining the second receiving hole to push the other end 105 of the parallel adjustment shaft 102 toward the lower fixing surface 122 of the printing head 41'.

An adjustment operation of the adjusting apparatus 100 adjusting the position of the printing head 41' in accordance with the embodiment of the present invention will now be explained with reference to FIGS. 5 and 6.

As shown in FIG. 6, when a lower fixing surface 122 of a printing head 41' is spaced-apart from the one end 103 of the parallel adjustment shaft 102, first, an actuation lever 115 is rotated about the rotation axle 120 in a clockwise direction by a user to allow a projection 118 to be inserted into a next locking groove 119 in the clockwise direction. As the actuation lever 115 is rotated in the clockwise direction, the eccentric cam 113 engaged with the one end 103 of the parallel adjustment shaft 102 is also rotated in the clockwise direction. Consequently, as the one end 103 of the parallel adjustment shaft 102 comes in contact with the cam surface of the eccentric cam 113, the eccentric distance between the parallel adjustment shaft 102 and a center of the rotation axle 120 varies. The one end 103 of the parallel adjustment shaft 102 is moved in an arrow direction A, i.e., a direction in which the eccentric cam 113 comes in contact with the lower fixing surface 122 of the printing head 41' by the elastic spring of the pressing part 114. In the same manner, the actuation lever 115 is rotated until the lower fixing surface 122 of the printing head 41' is maintained to be parallel to the parallel adjustment shaft 102 or the carrier shaft 42'. When the lower fixing surface 122 of the printing head 41' is parallel to the parallel adjustment shaft 102 or the carrier shaft 42', the projection 118 is locked onto the locking groove 119 disposed adjacent to the actuation lever 115, and then the adjustment operation is completed.

On the contrary, if the lower fixing surface 122 of the printing head 41' is disposed too close to the one end 103 of the parallel adjustment shaft 102 or the carrier shaft 42' and is not parallel to the carrier shaft 42', the actuation lever 115 is in a counterclockwise direction rotated by the user to allow the projection 118 to be inserted into a next locking groove 119 in the counterclockwise direction. At this time, the eccentric cam 113 is also rotated in the counterclockwise direction, and thereby the one end 103 of the parallel adjustment shaft 102 is moved away from the lower fixing surface 122 of the printing head 41' against the elastic spring of the pressing part 114. In the same manner, the actuation lever 115 is rotated until the lower fixing surface 122 of the printing head 41' is maintained to be parallel to the parallel adjustment shaft 102 or the carrier shaft 42'. After the lower fixing surface 122 of the printing head 4' becomes being parallel to the parallel adjustment shaft 102 or the carrier shaft 42', the projection 118 is locked onto the locking groove 119 disposed adjacent to the position to which the actuation lever 115 is rotated, and the adjustment operation is completed.

As apparent from the foregoing description, it can be appreciated that the apparatus for adjusting the position of the printing head of the present invention can prevent the switching problem which ink is unevenly injected on the paper to be printed, by adjusting the position of the parallel adjustment shaft which makes the fixing face of the printing head mounted in the head carrier to be parallel to the carrier shaft of guiding the movement of the head carrier.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. An apparatus in an inkjet printer having a printing head mounted in a head carrier moving along a carrier shaft to eject ink to perform a printing operation, comprising:

an adjusting unit disposed in the head carrier to adjust a position of the printing head with respect to the head carrier and control an arrangement or orientation of the printing head disposed in the head carrier, the adjusting unit comprising, a positioning member disposed in the head carrier to position and mount the printing head at a predetermined position, and a positioning member adjuster adjusting a position of the positioning member to adjust the arrangement or the orientation of the printing head, and having a parallel adjustment shaft positioning and mounting a lower surface of the printing head to be parallel to the carrier shaft at a lower part of the head carrier.

2. The apparatus according to claim 1, wherein the positioning member adjuster comprises:

a first receiving hole formed at the head carrier to receive and support the parallel adjustment shaft to move in a direction perpendicular to an axial direction of the parallel adjustment shaft;

an eccentric cam disposed at the head carrier in the vicinity of the first receiving hole to come in contact with the parallel adjustment shaft;

an actuation lever formed at one side of the eccentric cam to rotate the eccentric cam; and a pressing part pushing the parallel adjustment shaft to be in contact with the eccentric cam.

3. The apparatus according to claim 2, wherein the pressing part comprises:

a wall defining the first receiving hole;

a first elastic spring disposed in a first mounting groove formed in the wall to push the parallel adjustment shaft toward the eccentric cam.

4. The apparatus according to claim 3, wherein the positioning member adjuster is disposed at the head carrier in relation to one end of the parallel adjustment shaft.

5. The apparatus according to claim 4, wherein the adjusting unit comprises an additional pressing part disposed at the head carrier in relation to the other end of the parallel adjustment shaft to push the other end of the parallel adjustment shaft toward the fixing surface of the printing head to control the other end of the parallel adjustment shaft to be within an adjusting range of the positioning member adjuster without overly moving away from the fixing surface of the printing head.

6. The apparatus according to claim 5, wherein the additional pressing part comprises:

a second receiving hole formed at the head carrier to allow the other end of the parallel adjustment shaft to move in the direction perpendicular to the axial direction of the parallel adjustment shaft;

a second wall defining the second receiving hole and having a second mounting groove; and a second elastic spring disposed in the second mounting groove to push the other end of the parallel adjustment shaft toward the fixing surface of the printing head.

7. The apparatus according to claim 3, wherein the positioning member further comprises:

a plurality of selected positions; and a locking part releasably locking up the actuation lever in one of the selected positions.

8. The apparatus according to claim 7, wherein the locking part comprises:

a projection formed at an end of the actuation lever; and at least one locking groove formed at a portion of the head carrier corresponding to the projection along a movement path thereof.

9. An apparatus in an inkjet printer having a carrier shaft, a head carrier moving along the carrier shaft, and a printing head mounted in the head carrier, comprising:

a position adjusting unit disposed between the head carrier and the printing head to adjust a position of the printing head with respect to the head carrier, having a positioning member movably coupled to the head carrier to contact the printing head when the printing head is mounted in the head carrier, and having an adjusting member movably coupled to the head carrier to contact to the positioning member, controlling the positioning member to move the printing head, wherein the head carrier comprises sidewalls, a bottom formed between the sidewalls, a receptacle defined by the sidewalls and the bottom to receive the printing head when the printing head is mounted in the head carrier, and two holes formed on the sidewalls, and the positioning member comprises two ends movably inserted into corresponding holes of the sidewalls of the head carrier.

10. The apparatus of claim 9, wherein the position adjusting unit controls the printing head to be oriented toward the carrier shaft.

11. The apparatus of claim 9, wherein the position adjusting unit controls the printing head to move away and close to the carrier shaft.

12. The apparatus of claim 9, wherein the printing head comprises a surface contacting the position adjusting unit in a non-parallel position, which is not parallel to the carrier shaft, when the printing head is mounted in the head carrier, and the position adjusting unit controls the printing head to move the surface of the printing head from the non-parallel position to a parallel position parallel to the carrier shaft.

13. The apparatus of claim 9, wherein the adjusting member controls the positioning member to move away and toward the carrier shaft, and the positioning member controls the printing head to be parallel to the carrier shaft.

14. The apparatus of claim 9, wherein the position adjusting unit comprises:

an elastic member disposed between the positioning member and the head carrier to bias the positioning member toward the adjusting member.

15. The apparatus of claim 14, wherein the positioning member is disposed between the elastic member and the adjusting member to be biased toward the adjusting member.

16. The apparatus of claim 9, wherein the adjusting member comprises:

a cam disposed in one of the holes to contact the positioning member.

17. The apparatus of claim 16, wherein the adjusting member comprises:

a rotation axle rotatably mounted on the head carrier to rotate the cam.

18. The apparatus of claim 17, wherein the rotation axle is parallel to the carrier shaft.

19. The apparatus of claim 17, wherein the positioning member moves in a direction parallel to a line connected between centers of the rotation axle and the carrier shaft.

20. The apparatus of claim 17, wherein the positioning member moves in a radial direction of the rotation axle.

21. The apparatus of claim 9, wherein the positioning member is movable with respect to the carrier shaft and the head carrier.

22. The apparatus of claim 9, wherein at least one of the holes is an elliptical shape.

23. The apparatus of claim 22, wherein the elliptical shape of the one of the holes has a long axis along which the positioning member moves.

24. The apparatus of claim 9, wherein one of the holes has a long axis parallel to a line connected between centers of the adjusting member and the carrier shaft, and the positioning member moves along the long axis in response to a movement of the adjusting member.

25. The apparatus of claim 9, wherein one of the holes has a long axis parallel to a line parallel to a line connected between centers of the adjusting member and the positioning member, and the positioning member moves along the long axis in response to a movement of the adjusting member.

26. The apparatus of claim 9, wherein the holes both are an elliptical shape having a long axis parallel to one of a first line connected between centers of the adjusting member and the carrier shaft and a second line connected between centers of the adjusting member and the positioning member, and the positioning member moves along the long axis in response to a movement of the adjusting member.

27.The apparatus of claim 9, wherein the position adjusting unit comprises a pair of elastic members disposed in the respective holes to push corresponding ends of the positioning member along the long axis.

28. The apparatus of claim 9, wherein the adjusting member is disposed adjacent to one of the two holes to control one of the two ends of the position adjusting unit.

29. The apparatus of claim 28, wherein the position adjusting unit comprises an additional adjusting member disposed adjacent to the other one of the two holes to control the other one of the two ends of the position adjusting unit.

30. A method in an inkjet printer having a carrier shaft, a head carrier moving along the carrier shaft and having two sidewalls and a bottom forming a receptacle to receive a printing head when the printing head is mounted in the head carrier, and a position adjusting unit disposed between the head carrier and the printing head, the method comprising:

causing holes to be formed on corresponding ones of the sidewalls;

causing a position adjusting unit to be disposed between the head carrier and the printing head to adjust a position of the printing head with respect to the head carrier;

causing a positioning member of the position adjusting unit to movably contact the sidewalls of the head carrier through corresponding ones of the holes to contact a surface of the printing head when the printing head is mounted in the head carrier, causing an adjusting member of the position adjusting unit to be movably coupled to one of the two sidewalls of the head carrier to contact to the positioning member; and moving an adjusting member of the position adjusting unit to control the positioning member of the position adjusting unit to adjust the printing head with respect to the carrier shaft until the surface of the printing head is parallel to the carrier shaft.

31. The method of claim 30, wherein the positioning member comprises a cam disposed in one of the holes to contact the positioning member and an elastic member disposed in the one of the holes and between the positioning member and the head carrier, and the method comprises:

elastically biasing the positioning member against the cam of the adjusting member.

32. The method of claim 31, wherein the position adjusting unit comprises a locking unit disposed between the adjusting member and one of the sidewalls of the head carrier, and the method comprises:

locking the adjusting member onto the head carrier when the printing head is moved in a position parallel to the carrier shaft in response to a movement of the positioning member.

33. An apparatus in an inkjet printer having a carrier shaft, a head carrier moving along the carrier shaft and having two sidewalls and a bottom forming a receptacle to receive a printing head when the printing head is mounted in the head carrier, comprising:

holes formed on corresponding ones of the sidewalls; and a position adjusting unit disposed between the head carrier and the printing head to adjust a position of the printing head with respect to the head carrier, wherein the position adjusting unit comprises, a positioning member movably contacting the sidewalls of the head carrier through the receiving holes to contact a surface of the printing head when the printing head is mounted in the head carrier, and an adjusting member movably coupled to one of the two sidewalls of the head carrier to contact the positioning member, and controlling the positioning member to move the printing head.

34. The apparatus of claim 33, wherein the positioning member comprises:

two ends movably inserted into corresponding ones of the holes of the sidewalls of the head carrier.

35. The apparatus of claim 33, wherein the adjusting member comprises:

a cam contacting the positioning member; and a rotation axle rotatably mounted on the head carrier to rotate the cam.

36. The apparatus of claim 35, wherein the adjusting member comprises:

an elastic member disposed between the positioning member and the head carrier to elastically bias the positioning member against the cam of the adjusting member.

37. The apparatus of claim 36, wherein the elastic member and an end of the positioning member are disposed in one of the holes of the sidewalls.

* * * * *

UNITED STATES PATENT AND TRADEMARK OFFICE

CERTIFICATE OF CORRECTION

PATENT NO. : 6,644,765 B2
DATED : November 11, 2003
INVENTOR(S) : Gui-taek Lim

It is certified that error appears in the above-identified patent and that said Letters Patent is hereby corrected as shown below:

Column 7,
Line 10, indent paragraph
Line 13, indent paragraph
Lines 45, 48 and 60, change “fixing” to -- lower --

Signed and Sealed this

Eighteenth Day of May, 2004

JON W. DUDAS
*Acting Director of the United States Patent and Trademark Office*